US005653609A

United States Patent [19]

Orstad et al.

[11] Patent Number: 5,653,609

[45] Date of Patent: Aug. 5, 1997

[54] STRAIN RELIEF FOR AN ELECTRICAL CONNECTOR

[75] Inventors: Richard Edward Orstad, Greensboro; Michael Paul Trull, Winston-Salem; Jeffrey Allen Dinkel, Greensboro, all of N.C.

[73] Assignee: The Whitaker Corporation, Wilmington, Del.

[21] Appl. No.: 508,648

[22] Filed: Jul. 28, 1995

[51] Int. Cl.[6] ..... H01R 13/58

[52] U.S. Cl. ..... 439/472

[58] Field of Search ..... 439/470–473

[56] References Cited

U.S. PATENT DOCUMENTS

| | | | |
|---|---|---|---|
| 3,858,960 | 1/1975 | Kunkle et al. | 339/103 |
| 4,125,312 | 11/1978 | Aimar | 339/107 |
| 4,448,474 | 5/1984 | Melnychenko | 339/103 M |
| 4,516,822 | 5/1985 | Wolfel | 339/103 M |
| 4,526,435 | 7/1985 | Borne et al. | 339/103 C |
| 4,582,384 | 4/1986 | Frantz et al. | 439/610 |
| 4,653,832 | 3/1987 | Sanchez | 339/103 R |
| 4,657,331 | 4/1987 | Coldren | 339/125 R |
| 4,749,369 | 6/1988 | Wang | 439/459 |
| 4,842,550 | 6/1989 | Fry, Jr. et al. | 439/471 |
| 4,925,401 | 5/1990 | Fogg et al. | 439/465 |
| 5,178,559 | 1/1993 | Mello | 439/472 |
| 5,409,396 | 4/1995 | Bowen et al. | 439/465 |

*Primary Examiner*—Gary F. Paumen

[57] ABSTRACT

The invention comprises a strain relief for an electrical connector wherein the connector has conductor wires extending therefrom. The strain relief comprises a pair of hermaphroditic components. The forward end of the component has a connector engaging section for engaging the connector. The rearward end has a conductor engaging section to secure the conductor wires which extend from the connector. The inner side has two fastening members for securing one of the members to the other. The first of the fastening members is disposed near the rearward end of the component. The second of the fastening members is disposed near the forward end and the connector engaging section. The fastening members are used to secure the components together. The forward end is adjustable independently of the rearward end such that the strain relief is able to fit different size connectors and to accommodate different sizes and numbers of conductor wires.

14 Claims, 5 Drawing Sheets

STRAIN RELIEF FOR AN ELECTRICAL CONNECTOR

FILED OF THE INVENTION

The invention relates to a strain relief for an electrical connector and more particularly to a strain relief which can be used for several different size connectors having different numbers of wires.

BACKGROUND OF THE INVENTION

U.S. Pat. No. 4,125,312 discloses a connector having an insulating body formed from a pair of similar half-shells. The body has a portion which is connected to the electrical connector and another portion is a cable clamping portion. Two of the similar half shells are placed around the connector and the cable to form an electrical apparatus.

U.S. Pat. No. 4,526,435 discloses an electrical connector having a removable strain relief member. The strain relief member is made of two hermaphroditic components which attach to the back of the connector. The cable clamping portion of the strain relief has a notched tongue at one end and a locking aperture at the other. The notched tongue on one component is received into the locking aperture on another component to clamp down on the cable to secure the cable to the back of the connector.

It would be an advantage to have a strain relief that fits several size connectors and also several sizes of cables.

SUMMARY OF THE INVENTION

The invention comprises a strain relief for an electrical connector wherein the connector has conductor wires extending therefrom. The strain relief comprises a pair of hermaphroditic components. Each of the components have an outer side, an inner side, a forward end and a rearward end. The forward end has a connector engaging section engaging the connector. The rearward end has a conductor engaging section to secure the conductor wires which extend from the connector. The inner side has two fastening members for securing one of the members to the other. The first of the fastening members being disposed near the rearward end of the component. The second of the fastening members being disposed near the forward end and the connector engaging section. Each component has two complementary fastening members, the first complementary fastening member being near the rearward end, the second complementary fastening member being near the forward end and the connector engaging section. The fastening members and the complementary fastening members being used to secure the components together. The forward end is adjustable independently of the rearward end such that the strain relief is able to fit different size connectors and to accommodate different sizes and numbers of conductor wires.

The invention further includes an electrical connector assembly, wherein the assembly comprises a connector housing having a mating end, a rearward end, a top, and a bottom, and projections extending from the top and the bottom of the housing along the rearward end. The housing has contact receiving cavities with contacts therein. The contacts are terminated to conductor wires which extend out of the housing though the rearward end. A strain relief member comprises two hermaphroditic components. Each component having a connector engaging section and a conductor engaging section. The component includes two fastening members. The first fastening member being proximate to the conductor engaging section and the second fastening member being proximate to the conductor engaging section. The fastening members operate independently of each other and the first fastening member is used to secure the components together on the connector housing and the second fastening member being used to secure the components around the conductor wires.

BRIEF DESCRIPTION OF THE DRAWINGS

An embodiment of the present invention will now be described with reference to the attached drawings, in which.

DETAILED DESCRIPTION OF THE DRAWINGS

Figure 1:
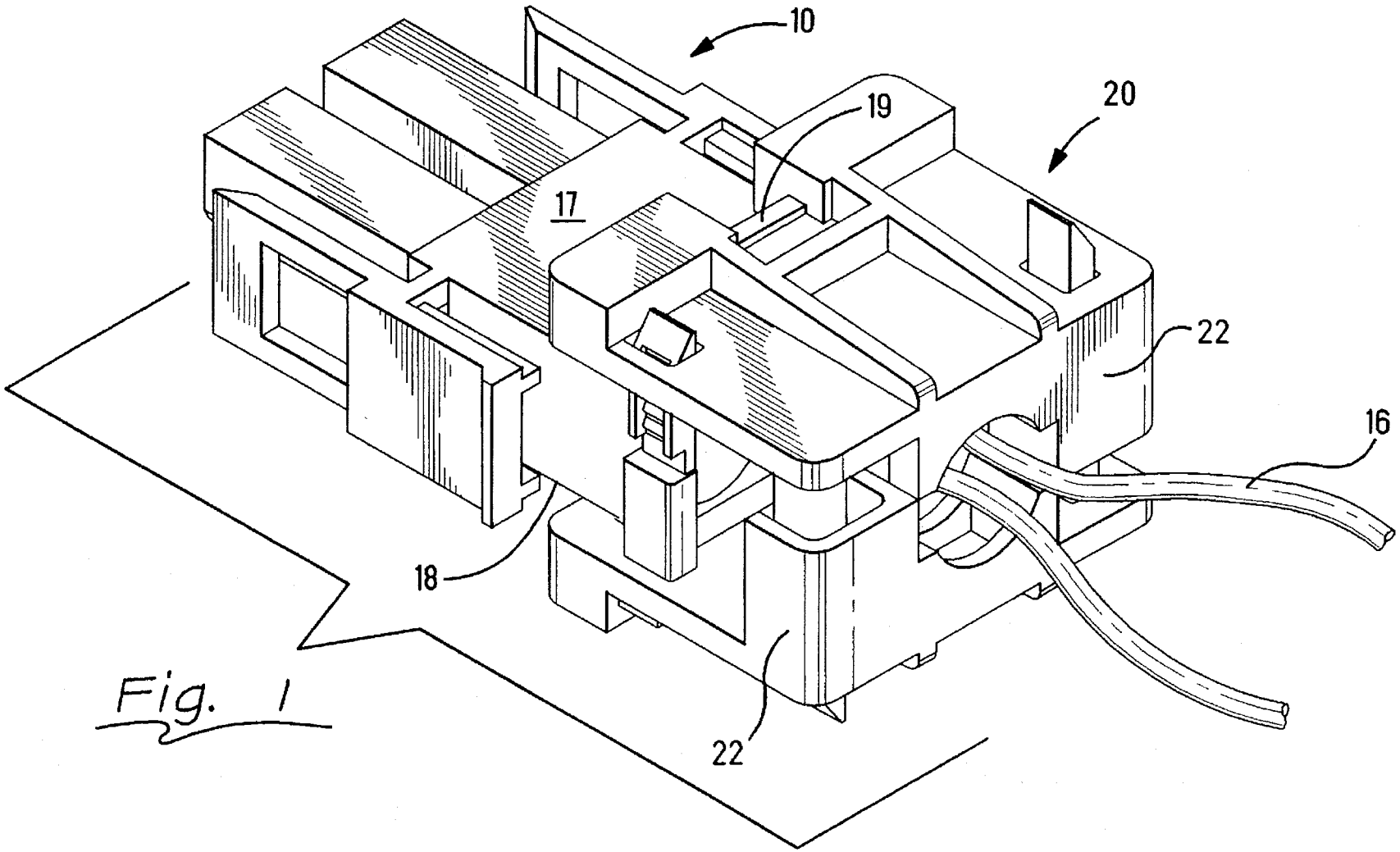
FIG. 1 is an isometric view showing the strain relief of the current invention attached to an electrical connector.
Figure 2:
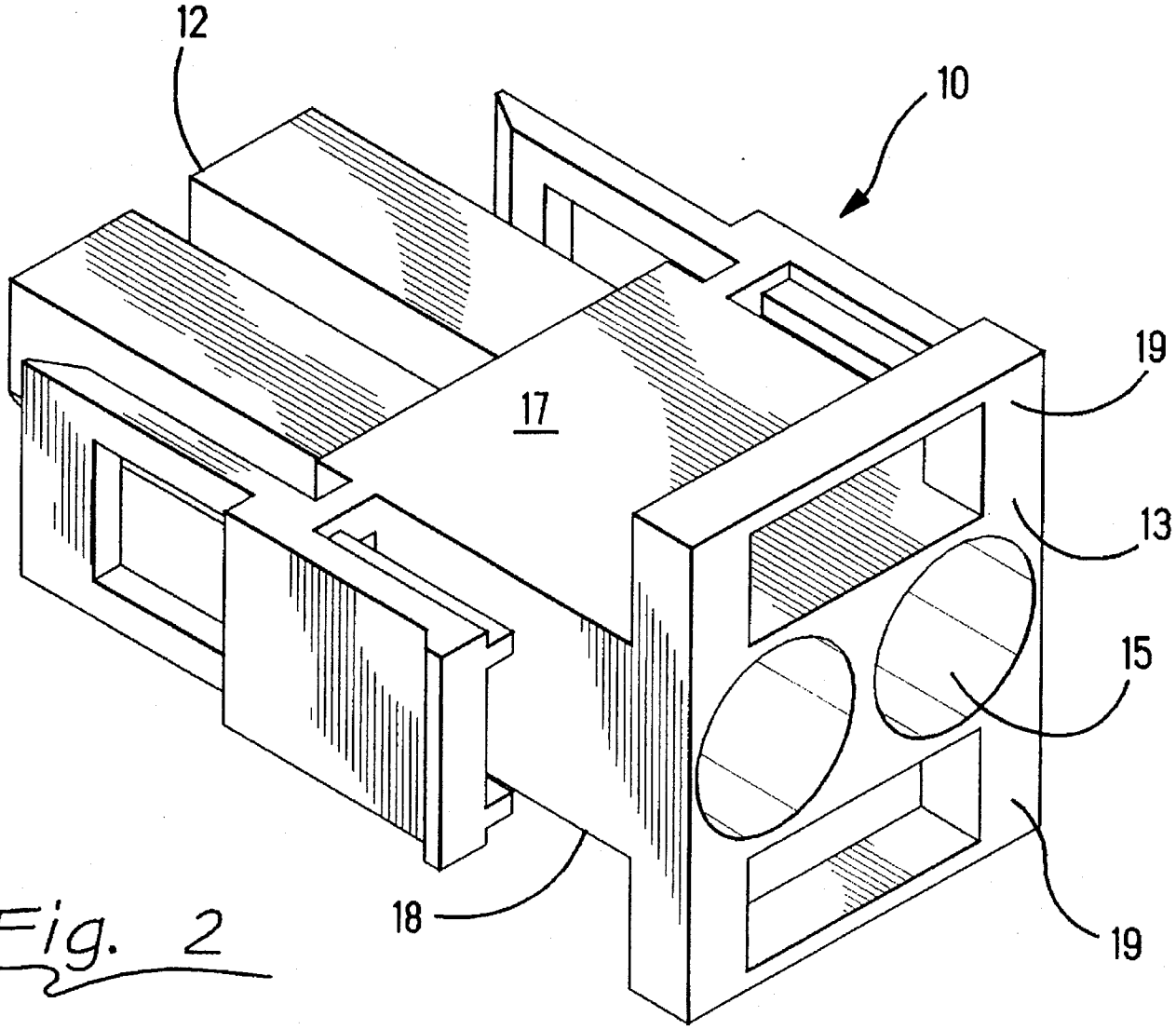
FIG. 2 is an isometric view of the connector.

FIG. 1 shows the strain relief 20 of the current invention attached to an electrical connector 10. FIG. 2 shows the connector as a typical connector 10 which has a mating face 12, a rearward face 13, and terminals, not shown, disposed within contact receiving cavities 15. The particular connector shown has contact silos and contact receiving cavities 15 which extend from the mating face 12 to the rearward face 13. While the connector shown only has two terminals and contact silos, the strain relief could be used on several different sizes and styles of connectors. The terminals are terminated to individual conductor wires 16 which extend out of the rearward face 13 of the connector, as is shown in FIG. 1. Outside of the connector, the conductor wires are typically surrounded by some type of insulative material to protect the wires and to prevent short circuiting between the wires. The insulated conductor wires can then be bundled and wrapped by another insulative layer forming a cable, or they can be left as individual wires, as is shown in FIG. 1, depending on the specific application.

The electrical connector 10 has projections 19 which extend from the top 17 and the bottom 18 of the connector along the rearward face 13, see FIG. 2. These projections 19 are used to secure the strain relief 20 to the rearward portion of the connector 10.

Figure 3:
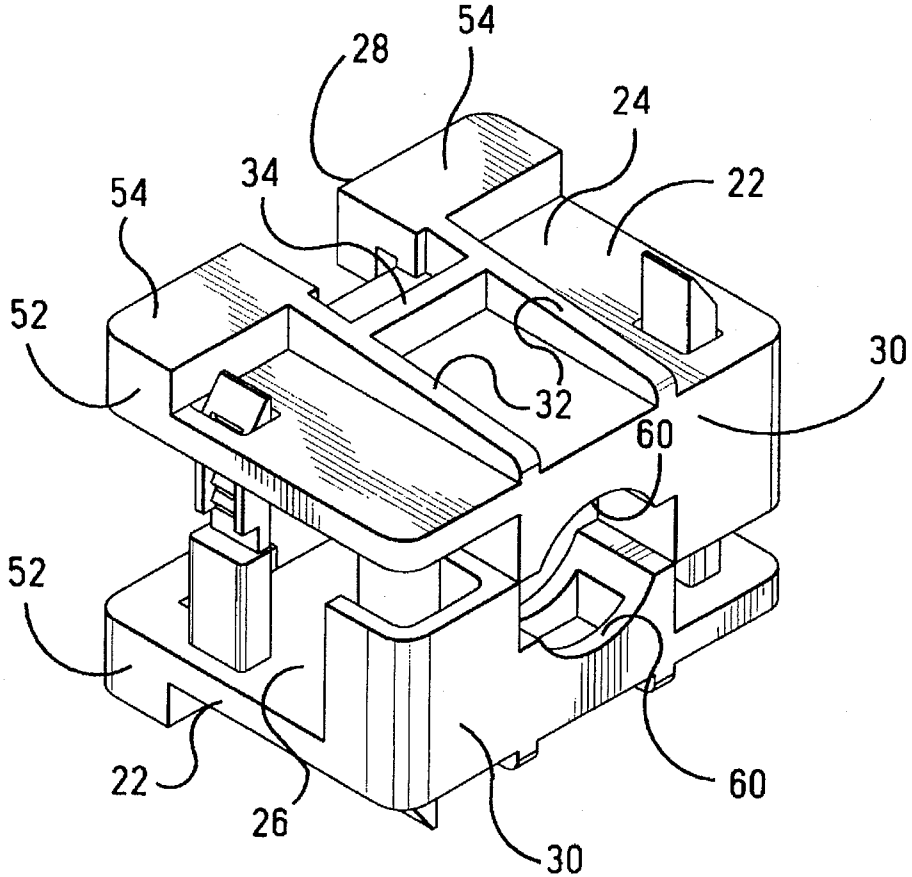
FIG. 3 is an isometric view of the two components of the strain relief.
Figure 6:
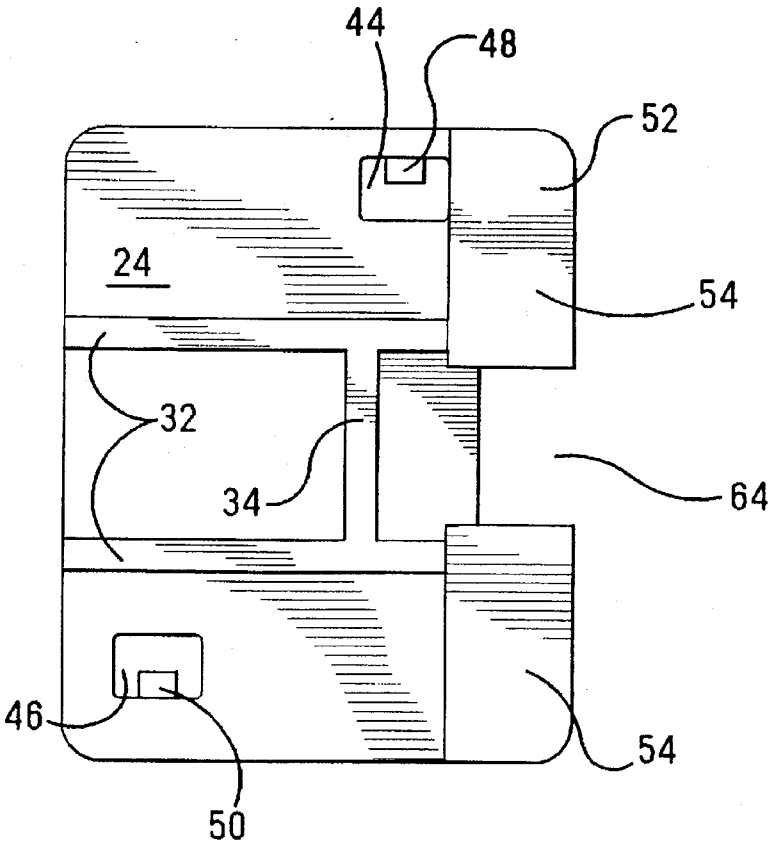
FIGS. 5, 6, 7, and 8 are top, bottom, side and rear views of one of the components respectively.

The strain relief 20 comprises two hermaphroditic components 22 which are secured to each other and to the rearward end 13 of the connector 10, see FIG. 3. Each component 22 has an outer surface 24 and an inner surface 26, a forward end 28 and a rearward end 30. The component 22 is generally flat and is generally rectangularly shaped. The outer surface 24 has two parallel ribs 32 which extend from near the forward end 28 towards the rearward end 30. An additional rib 34 extends between the two parallel ribs 32. The ribs 32, 34 provide strength to the component 22.

Figure 9:
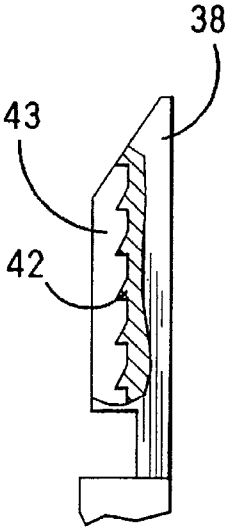
FIG. 9 is a partial cross sectional view of one of the rearward ratchet pegs, taken from section 9 in FIG. 8.
Figure 7:
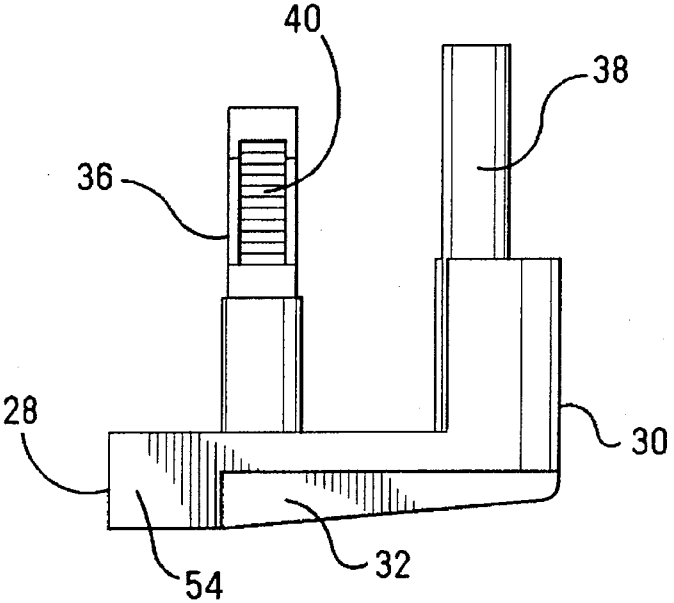

Each component has two ratchet pegs 36, 38 which extend upwardly from the inner surface 26. The ratchet pegs 36, 38 each have locking teeth 40, 42 thereon and two walls 41, 43 on either side of the locking teeth 40, 42 to protect the teeth from damage. FIG. 9 shows the teeth 42 on the rearward ratchet peg 38 and shows how the walls 43 extend alongside the teeth. One ratchet peg 38 is disposed towards the rearward end 30 of the component 22 and its locking teeth 42 are directed toward that adjacent side. The other ratchet peg 36 is disposed on the opposite side of the component 22 towards the forward end 28 and its locking teeth 40 are directed toward that opposite side. The component 22 also has two locking apertures 44, 46. Each aperture 44, 46 has a locking tooth 48, 50 which engages the teeth 40, 42 on the ratchet peg 36, 38 when the components are mated together.

Figure 4:
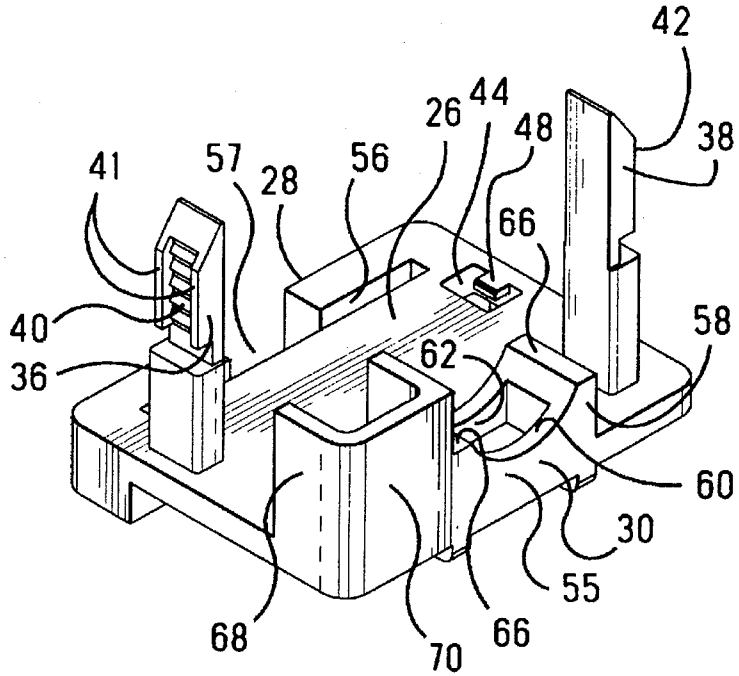
FIG. 4 is a top isometric view of one of the components of the strain relief.
Figure 5:
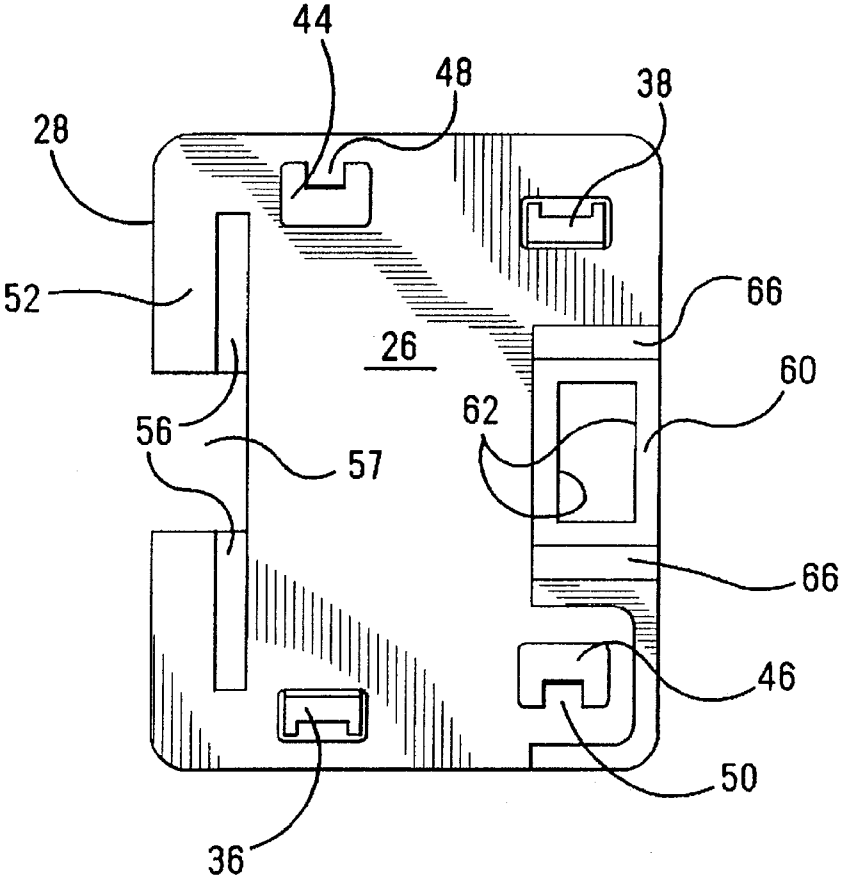
Figure 8:
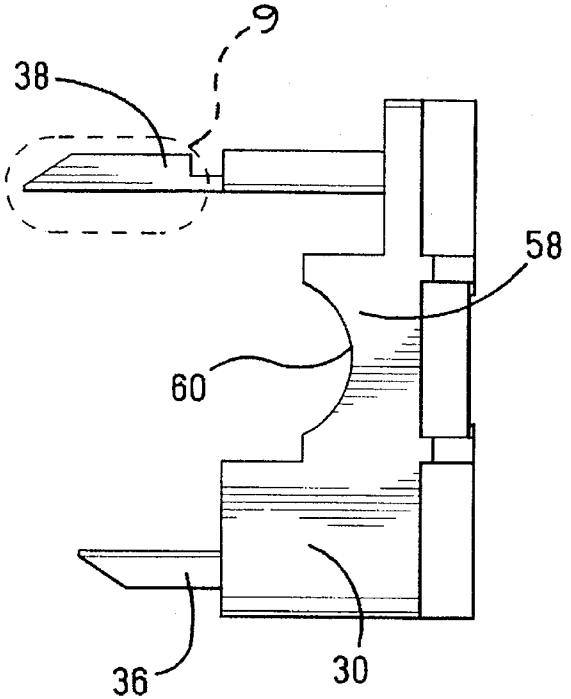

Along the forward end 28 of the component 22 is a connector engaging section 52. The connector engaging section 52 includes two projections 54 along the outer surface 24 of the strain relief 20 and two slots 56 formed along the inner surface 26, see FIGS. 4 and 5. A space 57 exists between the two projections 54 and the two slots 56. The two slots 56 along the inner surface 26 are in alignment with each other to receive the projection 19 from the connector 10. When two components 22 are brought together to engage the connector 10, the slots 56 on one component 22 will engage the projection 19 on the top 17 of the connector. The slots 56 on the other component 22 will engage the projection 19 on the bottom 18 of the connector 10.

Each component 22 has a conductor receiving projection 55 along the rearward end 30 with a concave shaped conductor receiving area 60 therealong. The conductor receiving projection 55 is hollow in the middle and has walls 62 which upstand from the inner surface 26 to the conductor receiving area 60. Along either side of the concave shaped conductor receiving area 60 are two flat surfaces 66 which are parallel to the inner surface 26.

Around the rearward locking aperture 46, there are U-shaped, upstanding walls 68. The base 70 of the U-shape is along the rearward end 30 of the component. The walls 68 are attached to the adjacent conductor receiving projection 55.

The strain relief 20 is installed over the rearward end 13 of the connector 10 in which the terminals and the conductor wires 16 have already been installed, see FIG. 1. One component 22 is received along the top 17 and one component 22 is received along the bottom 18 of the connector. When aligned this way, the forward ratchet peg 36 is aligned with the forward locking aperture 44, the rearward ratchet peg 38 is aligned with the rearward locking aperture 46, and the concave shaped conductor receiving areas 60 are aligned with each other, see FIG. 3. The U-shaped walls 68 of one component 22 are received next to the conductor receiving projection 55 of the other component. The conductor wires 16 or the cable are received between the concave shaped conductor receiving areas 60 on both components, see FIG. 1. The forward ratchet peg 36 is received in the forward locking aperture 44, see FIG. 3. The components 22 are then pressed together to fit securely around the connector. The ratchet peg 36 will be received into the locking aperture 44 at a depth necessary to secure the strain relief 20 to the connector 10. The projections 19 on the connector 10 being received within the slots 56 of the components 22. The strain relief can fit a variety of different size connectors as the forward ratchet peg has several locking teeth and can be secured at different teeth along the ratchet peg and therefore at different depths.

The rearward ratchet peg 38 is received in the rearward locking aperture 46. The rearward ends 30 of the components 22 are pressed together with the cable or conductors in the cable receiving area 60 until the cable or conductors are securely held between the components. The U-shaped walls 68 and the flat surfaces 66 define the extent to which the rearward ends 30 of the components 22 can pushed together. When fully pushed together, the flat surfaces 66 and the top of the U-shaped walls 68 on one component 22 will engage the flat surfaces 66 and the inner surface 26 on the other component respectively. The strain relief can accommodate various numbers of conductors or various cable sizes as the rearward ratchet peg 38 can be secured at several different depths in the rearward locking aperture 46. The rearward ratchet peg 38 can operate independently of the forward ratchet peg 36 and therefore the strain relief 20 can accommodate different numbers of conductor wires for the same size connector and conversely, the strain relief can accommodate different size connectors which have the same number and size of conductor wires.

The strain relief of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A strain relief for an electrical connector having conductor wires extending therefrom, the strain relief comprising:

a pair of hermaphroditic components, each of the components having an outer side, an inner side, a forward end and a rearward end, the forward end having a connector engaging section for being secured to the connector, the rearward end having a conductor engaging section to secure the conductor wires which extend from the connector, the inner side having two fastening members for securing one of the components to the other, a first of the fastening members being disposed near the rearward end of the component, a second of the fastening members being disposed near the forward end and the connector engaging section, the first and the second fastening members being ratchet pegs which extend upwardly from the inner surface and have locking teeth therealong, each component having two complementary fastening members, the first complementary fastening member being near the rearward end, the second complementary fastening member being near the forward end and the connector engaging section;

whereby the fastening members and the complementary fastening members are usable to secure the components together, and the forward end is adjustable independently of the rearward end such that the strain relief is able to fit different size connectors and to accommodate different sizes and numbers of conductor wires.

2. The strain relief of claim 1, wherein the first and the second complementary fastening members are apertures each with a locking tooth therein, the locking tooth in each aperture engaging the locking teeth on a respective one of the ratchet pegs to secure the components together.

3. The strain relief of claim 1, wherein the connector engaging section includes a slot which is used to engage the connector.

4. The strain relief of claim 1, wherein the conductor engaging section comprises a concave section, the concave section being formed from walls which extend from the inner surface.

5. The strain relief of claim 1, wherein the outer surface of the component has ribs.

6. The strain relief of claim 2, wherein U-shaped walls partially surround the aperture of the first complementary fastening member, the walls extend upwardly from the inner surface of the component and are attached to the conductor receiving area, a top of the U-shaped walls forming a stop for the other component when the components are secured together.

7. The strain relief of claim 4, wherein there are two flat sections on either side of the concave section, the flat sections forming a stop for the other component when the two components are secured together.

8. An electrical connector assembly, comprising:

a connector housing having a mating end, a rearward end, a top, and a bottom, projections extending from the top and the bottom of the housing along the rearward end, and conductor wires terminated in the housing and extending out of the housing through the rearward end; and a strain relief member comprising two hermaphroditic components, each component having a connector engaging section and a conductor engaging section, each component including two fastening members, a first of the fastening members being proximate to the conductor engaging section and a second of the fastening members being proximate to the connector engaging section, the first and the second fastening members being ratchet pegs which extend upwardly from the inner surface and have locking teeth therealong, each component further including two complementary fastening members, a first of the complementary fastening members being disposed near the rearward end, and a second of the complementary fastening members being near the forward end and the connector engaging section;

whereby the first and the second fastening members operate independently of each other, the first fastening member is used to secure the components around the conductor wires and the second fastening member is used to secure the components together on the connector housing.

9. The connector assembly of claim 8, wherein the first and the second complementary fastening members are apertures each with a locking tooth therein, the locking tooth in each aperture engaging the locking teeth on a respective one of the ratchet peg to secure the components together.

10. The connector assembly of claim 8, wherein the connector engaging section includes a slot which receives one of the projections of the connector.

11. The connector assembly of claim 8, wherein the conductor engaging section comprises a concave section, the concave section being formed from walls which extend from the inner surface.

12. The connector assembly of claim 8, wherein the outer surface of the component has ribs.

13. The connector assembly of claim 9, wherein U-shaped walls partially surround the aperture of the first complementary fastening member, the walls extend upwardly from the inner surface of the component and are attached to the conductor receiving area, a top of the U-shaped walls forming a stop for the other component when the components are secured together.

14. The connector assembly of claim 11, wherein there are two flat sections on either side of the concave section, the flat sections forming a stop for the other component when the two components are secured together.

* * * * *